US006307628B1

(12) United States Patent
Lu et al.

(10) Patent No.: US 6,307,628 B1
(45) Date of Patent: Oct. 23, 2001

(54) METHOD AND APPARATUS FOR CMP END POINT DETECTION USING CONFOCAL OPTICS

(75) Inventors: Chun-Hung Lu, Toliu; Mei-Yen Li, Tainan, both of (TW)

(73) Assignee: Taiwan Semiconductor Manufacturing Company, Ltd, Hsin Chu (TW)

( * ) Notice: Subject to any disclaimer, the term of this patent is extended or adjusted under 35 U.S.C. 154(b) by 0 days.

(21) Appl. No.: 09/641,472

(22) Filed: Aug. 18, 2000

(51) Int. Cl.[7] ..... G01B 11/06; G01N 21/55
(52) U.S. Cl. ..... 356/382; 356/445
(58) Field of Search ..... 356/415, 381, 356/382; 250/559.29, 559.28

(56) References Cited

U.S. PATENT DOCUMENTS 4,999,014 * 3/1991 Gold et al. ..... 356/382
5,658,183 * 8/1997 Sandhu et al. ..... 451/5
5,838,448 * 11/1998 Aiyer et al. ..... 356/382
6,020,968 * 2/2000 Horie ..... 356/382
6,142,855 * 11/2000 Nyui et al. ..... 451/67

* cited by examiner

*Primary Examiner*—Robert H. Kim
*Assistant Examiner*—Michael P. Stafira
(74) *Attorney, Agent, or Firm*—Tung & Associates

(57) ABSTRACT

End point detection during a CMP process on a semiconductor wafer employs confocal optics to increase signal-to-noise ratio near the end point. The use of confocal optics for sensing reflected light from the wafer surface exhibits greater selectivity where intermediate layers of metal are present in the wafer. A laser diode is used as a light source to examine the wafer surface. Light reflected back to the laser diode reduces its power state, and this power state is sensed by a current detector which outputs a signal representative of reflected light intensity.

19 Claims, 3 Drawing Sheets

METHOD AND APPARATUS FOR CMP END POINT DETECTION USING CONFOCAL OPTICS

TECHNICAL FIELD

The present invention broadly relates to semiconductor manufacturing processes, and deals more particularly with an improved method and apparatus for detecting the end point during chemical mechanical polishing (CMP) of a semiconductor wafer.

BACKGROUND OF THE INVENTION

In the fabrication of semiconductor devices from a silicon wafer, a variety of semiconductor processing equipment and tools are utilized. One of those processing tools is used for polishing thin, flat semiconductor wafers to obtain a planarized surface. A planarized surface is highly desirable on a shadow trench isolation (STI) layer, on an inter-layer dielectric (ILD) or on an intra-metal dielectric (IMB) layer which is frequently used in memory devices. The polarization process is important since it enables the use of a high resolution lithographic process to fabricate the next level circuit. The accuracy of the high resolution lithographic process can be achieved only when the process is carried out on a substantially flat surface. The planarization process is therefore important processing step in the fabrication of semiconductor devices.

A global planarization process is often carried out using a technique known as chemical mechanical polishing. (CMP). The CMP process has been widely used on ILD or IMD layers in fabricating modern semiconductor devices. The CMP process is carried out using a rotating platen in combination with a pneumatically polishing head. The process is used primarily for polishing the front side of the device surface of a semiconductor wafer for achieving planarization and for preparation of the next level processing. A wafer is frequently planarized one or more times during a fabrication process in order for the top surface of the wafer to be as flat as possible. A wafer can be polished in a CMP apparatus by being placed on a carrier and pressed face-down on a polishing pad covered with a slurry of colloidal silica or aluminum.

A polishing pad used on a rotating platen is typically constructed in two layers overlying a platen with a resilient layer as the outer layer of the pad. The layers are often made of a polymeric material such as polyurethane and may include a filler for controlling the dimensional stability of the layers. A polishing pad is normally made several times the diameter of a wafer while the wafer is kept off-center on the pad in order to prevent a non-planar surface from being formed on the wafer. The wafer itself is also rotated during the polishing process to prevent polishing a tapered profile into the wafer surface. The axis of rotation of the wafer and the axis of rotation of the pad are deliberately off-set, however these two axes must be maintained parallel. It is known that uniformity in wafer polishing using the CMP process is a function of pressure, angular velocity and concentration of the slurry.

A CMP process is frequently used in the planarization of an ILD or IMD layer on a semiconductor device. Such layers are typically formed of a dielectric material. A most popular dielectric for such usage is silicon oxide. In the process for polishing a dielectric layer, the goal is to remove typography while maintaining good uniformity across the entire wafer. The amount of dielectric material removed is normally between about 5,000 angstroms and about 10,000 angstroms. The uniformity requirement for ILD or IMD polishing is very stringent since non-uniform dielectric films lead to poor lithography and resulting window etching or plug formation difficulties. The CMP process has also been applied to polishing metals, for example, in tungsten plug formation and embedded structures. A metal polishing process involves a polishing chemistry that is significantly different than that required for oxide polishing.

The important component required in a CMP process is an automated rotating polishing platen and a wafer holder, which of both exert a pressure on the wafer and rotate the wafer independently of the rotation of the platen. The polishing or the removal of surface layers is accomplished by a polishing slurry consisting mainly of colloidal silica suspended in de-ionized water or KOH solution. The slurry if frequently fed by an automatic slurry feeding system in order to ensure the uniform wetting of the polishing pad and the proper delivery of the recovery of the slurry. For a high volume wafer fabrication process, automated wafer loading/unloading and a cassette handler are also included in a CMP apparatus.

As the name implies, a CMP process executes a microscopic action of polishing by both chemical and mechanical means. While the exact mechanism for material removal of an oxide layer is not known, it is hypothesized that the surface layer of silicon oxide is removed by a series of chemical reactions which involve the formation of hydrogen bonds with the oxide surface of both the wafer and the slurry particles in a hydrogenation reaction; the formation of hydrogen bonds between the wafer and slurry; the formation of molecular bonds between the wafer and the slurry; and finally, the breaking of the oxide bond with the wafer or the slurry surface when the slurry particle moves away from the wafer surface. It is generally recognized that the CMP polishing process is not a mechanical abrasion process of slurry against the wafer surface.

While the CMP process provides a number of advantages over the traditional mechanical abrasion type polishing process, a serious drawback of the CMP process is the difficulty in so-called "end point" detection. The CMP process is frequently carried out without a clear signal as to when the process is complete. In the past, end point detection was largely based on determining the empirical polishing rates and time. Since the calculation of polish time required based on empirical polishing rates is frequently inaccurate, the empirical method frequently fails to accurately predict the end point, thus resulting in scrap, and significant reductions in yield. Attempts have been made to utilize an end point detection mechanism that includes capacitance measurements and optical measurements. However none of these techniques has been entirely satisfactory in achieving accurate control, of the dielectric layer removed.

Another method for achieving end point detection involves directing a laser beam onto the surface of the wafer and analyzing the light reflected from the wafer surface to determine changes in optical interference that are related to the amount of material removed. Specifically, the light reflected from a patterned wafer surface is processed by digital filtering algorithms such that the intensity of the optical interference changes periodically with the thickness of removed surface material. This technique is sometimes adequate for the detection of the end point in a polishing process wherein only a relatively thin layer of material is removed. However, when a larger amount of material is removed on a semiconductor structure such as an IMD oxide layer having a thickness of 4,000 angstroms or larger, this technique does not provide reliable results because the detection system can not distinguish which of the wave form cycles that the end point coincides with. As a result, it is possible that the wafer surface is either over-polished or under-polished by a thickness as much as 2,400 angstroms.

One of the reasons that traditional optical end point detection methods are not effective when used to detect end point near IMD layers is that there is a relatively high amount of feedback noise included in the reflected optical signal. Moreover, when multiple IMD layers are present, the reflected optical signal includes components of both IMD layers, thus making it nearly impossible to determine the current polishing thickness relative to the IMD layer that is used as a reference depth. In other words, prior art optical techniques for detecting the end point in a CMP process possesses low signal-to-noise ratios, and poor longitudinal selectivity. Accordingly, there is a clear need in the art for an improved method and apparatus for detecting an end point that exhibits a high signal-to-noise ratio and superior longitudinal selectivity that is not affected by the presence of metal compound sub-layers. The present invention is directed towards satisfying this need.

SUMMARY OF THE INVENTION

According to one aspect of the invention, a method is provided for detecting an end point of a CMP process used in processing a semiconductor wafer, comprising the steps of passing light from a light source through a focusing lens such that the light is focused onto the wafer at a depth corresponding to a desired, final surface level; passing light reflected from the wafer back through the focusing lens onto an optical detector; and, detecting the intensity of the light received by the detector, wherein the detected light intensity is related to the end point. The light source is preferably a laser diode. The reflected laser light is desirably directed back to the laser diode such that the power state of the laser diode is a finction of the intensity of the reflected light, and is thus indicative of the current polishing depth. The detected light intensity reaches a maximum level, indicative of the end point, when the light directed onto the wafer surface is at the focal length of the lens. The method is preferably practiced using a confocal optical system in order to maximize selectivity of detection depth as well as the signal-to-noise ratio.

According to another aspect of the invention, apparatus is provided for detecting an end point of a CMP process used in processing semiconductor wafers. The apparatus includes a light source, preferably in the form of a laser diode. At least a first detector is used for detecting the intensity of light originating from the source and reflected from the surface of the wafer. At least a first optical lens focuses light from the source onto the wafer surface and also focuses light reflected from the surface back to the detector. The intensity of the light detected by the detector is related to the distance of the lens from the wafer surface, which is in turn related to the end point of the CMP process. Light reflected from the wafer surface is focused back to the laser diode, thereby affecting the power state of the laser diode, i.e. the electrical current drawn by the diode. The detector is preferably in the form of a means for sensing the current drawn by the laser diode, which is indicative of the level of intensity of the reflected light, and thus of the end point. In an alternative embodiment, a second light source, second detector and second optical lens are employed where a deformable polishing pad is used in the CMP process. This second set of optical components is used to detect the starting point of the CMP process which is then used as a reference for determining the final end point.

Accordingly, it is a primary object of the present invention to provide a method and apparatus for detecting the end point in a CMP process used to planarize semiconductor devices formed on a semiconductor wafer.

Another object of the invention is to provide a method and apparatus as described above which is suitable for use with semiconductor devices employing IMD layers that present multiple reflections and low signal-to-noise ratios in optical systems used to detect the end point.

A further object of the invention is to provide a method and apparatus of the type mentioned above which employs an optical end point detection system that exhibits a high signal-to-noise ratio, an improved longitudinal selectivity in detecting end points.

A still further object of the invention is to provide a method and apparatus as described above which employs a relatively compact optical system that obviates the need for precise alignment of optical components.

These, and other objects and advantages of the present invention will be made clear or will become apparent during the course of the following description of a preferred embodiment of the invention.

BRIEF DESCRIPTION OF THE DRAWINGS

In the drawings, which form an integral part of the specification and which are to be read in conjunction therewith, and in which like reference numerals are employed to designate identical components in the various views.

DESCRIPTION OF THE PREFERRED EMBODIMENT

Figure 1:
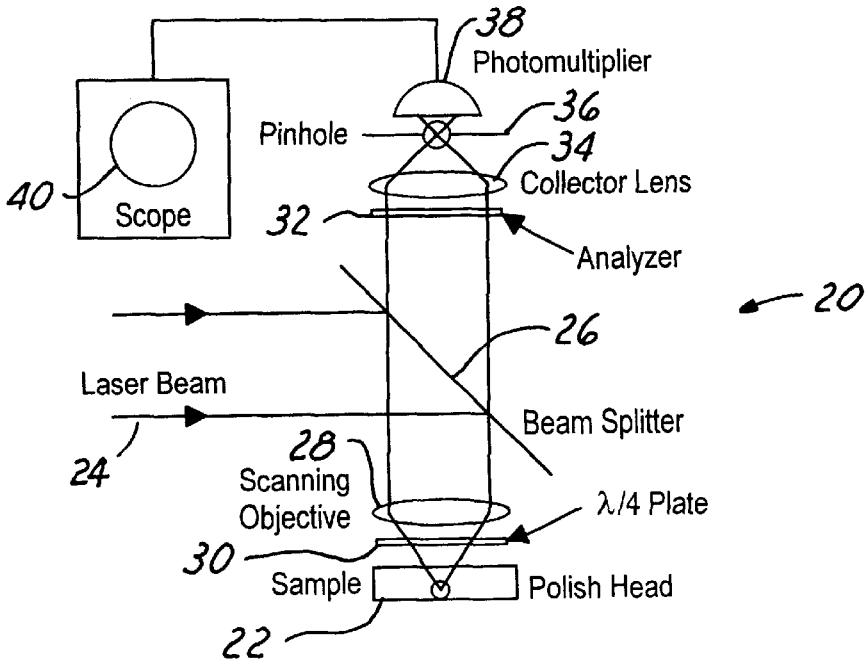
FIG. 1 is a diagrammatic view of a confocal microscope system that may be employed to carry out the method of the present invention.
Figure 3:
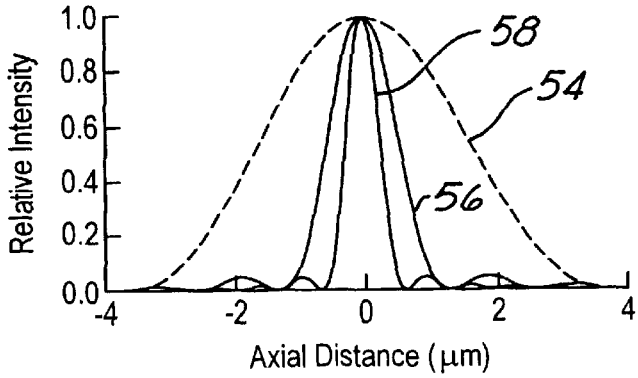
FIG. 3 is a chart showing the relationship between axial distance from the focal point, and the feed back intensity of reflected light for optical systems having several differing numerical apertures.

Referring first to FIG. 1, the present invention relates to a method and apparatus for end point detection in a CMP process that is especially useful where the semiconductor structure of the wafer has multiple metallic layers, especially IMD layers, that interfere with end point detection using known optical end point detection systems. The method of the present invention can be practiced using a confocal microscope and detection system, generally indicated by the numeral. The system includes a source of light, such as the laser beam which is directed onto a beam splitter that reflects the laser beam through a scanning objective lens and a quarter wavelength plate onto the surface of a wafer. The scanning objective lens focuses the laser beam at a point on a plane corresponding to the end point on the wafer The laser light reflected or scattered from the surface of the wafer passes back through the lens 28 and the beam splitter onto an analyzer 32. The analyzed light is passed through a collector lens 34 and a pinhole 36 onto a detection device such as a photo-multiplier 38. The photo-multiplier 38 detects the level of light intensity which may then be output to a digital readout (not shown) or scope 40. The intensity of the light detected by the photo-multiplier 38 is at a relative maximum when the wafer 22 has been polished down to the desired end point which corresponds to the plane at which the laser beam has been focused. When this occurs, a relative maximum amount of light is reflected from the wafer surface, since the laser beam focal point and the exposed wafer surface are in the same plane. The operating principles of the system described above are similar to a simple system in which a point light source is focused by a lens onto the surface of a mirror. If the mirror is positioned precisely at the focal point of the lens, a maximum amount of the light is reflected. If, however the mirror is longitudinally displaced, the reflected light scatters, and thus the intensity of the light reflected back through the focusing lens is reduced. Accordingly, the level of the light reflected through the focusing lens is indicative of the longitudinal position of the mirror, relative to the position of the mirror. The greater the magnification of the confocal lens that is employed, the more sensitive the system is for detecting displacement of the mirror, or in the case of the present invention, the wafer surface. For example, FIG. 3 depicts three curves respectively showing the relative intensity of reflected light as a function of distance from a central focal point for three differing lenses having respective numerical apertures of 0.40, 0.65, and 0.85. In the case of a lens having a numerical aperture of, 0.85, it can be seen from curve 58 that displacement of the wafer surface even a slight amount from the focal point, results in a dramatic drop-off of the intensity of the reflected light. Accordingly it can be appreciated that the use of a confocal system for sensing a desired end point in accordance with the present invention provides a high degree of longitudinal sensitivity and thus an accompanying high signal-to-noise ratio.

Figure 2:
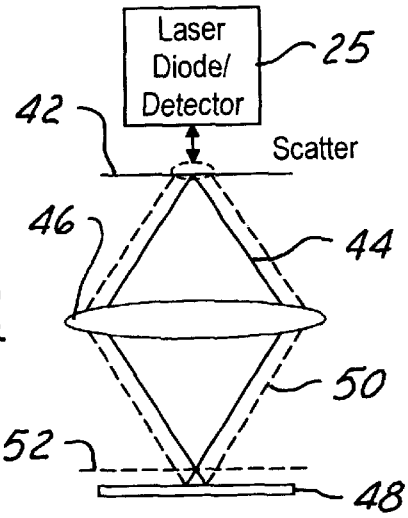
FIG. 2 is a diagrammatic view of a confocal optical detection system that forms the preferred embodiment of the present invention.

Although a confocal microscope optical system such as that shown in FIG. 1 may be employed to practice the present invention, the preferred embodiment employs a modified arrangement of optical components which are shown in FIG. 2. A source of laser light, such as the laser diode 25 directs a beam of light through a pinhole 42 so as to be disbursed at 44onto a confocal objective lens 46. The lens 46 focuses the laser beam at a plane 52. The focused laser beam impinges the surface of the wafer 48, and the scattered light is reflected at 50 back through the lens 46. The lens 46 focuses this reflected light back through the pinhole 42 to a detector which, as will later be appreciated, preferably forms an integral part of the laser diode device 25. It may be appreciated then that when the wafer surface is polished to a depth corresponding to the end point, such surface will coincide with the focal plane 52. Under the latter mentioned condition, a maximum amount of light will be reflected from the wafer surface and sensed by the detector 25.

Figure 8:
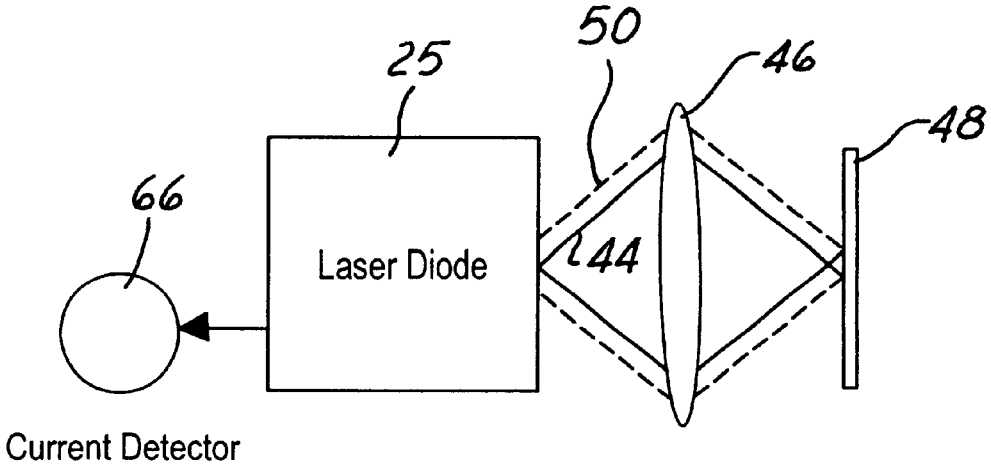
FIG. 8 is a diagrammatic view of the components of the optical system of the preferred embodiment.

Referring now to FIG. 8, according to the present invention, the light reflected from the wafer 48 can be focused by lens 46 directly back to the laser diode 25. The focused reflected light at 44 reduces the power of the output laser beam ,and consequently reduces the power state of the laser diode 25. The power state of laser 25 is directly related to the amount of electrical current consumed or drawn by the laser diode 25. Thus, by sensing the power state of the laser diode 25, a determination can be made of the reflected light intensity and thus of the polish depth, on a real-time basis. The power state of laser diode 25 can simply be determined by employing a current detector which detects the current drawn by laser diode 25 as described above. Although not specifically shown, the current detector 66 may be coupled to a PLC or other computer based process control device that controls the CMP process. When the current sensed by detector 66 reaches a pre-selected level corresponding to a desired end point, the process control equipment may terminate this process.

Figure 4:
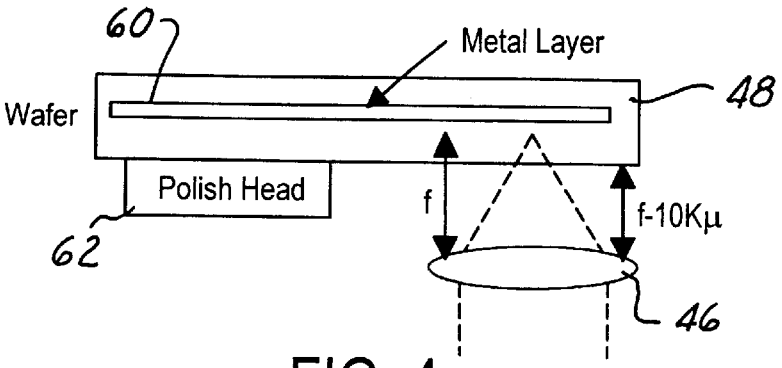
FIG. 4 is a diagrammatic view showing a portion of the optical system of the present invention in relationship to a polishing head and a wafer containing a metal layer.

FIG. 4 depicts the positioning of the confocal objective lens 46 relative to the wafer 48 and the polishing head 62 employed to perform the CMP process. Wafer 48 includes a metal layer 60 which represents the end point of the CMP process. The lens 46 is positioned relative to its central optic axis, such that its focal point is spaced a distance "f" from the metal layer 60. If the distance between the starting wafer surface and the metal layer 60 is, for example, 10,000 microns, then the lens 46 would be placed at a starting position of f-10,000 microns at the beginning of the CMP process. Accordingly, when the polishing head 62 polishes the wafer surface down to a plane corresponding to the metal layer 60, the light focused onto the wafer surface 46 will be at the latter's focal point and thus a maximum intensity of light will be detected, thereby indicating arrival at the end point.

Figure 6:
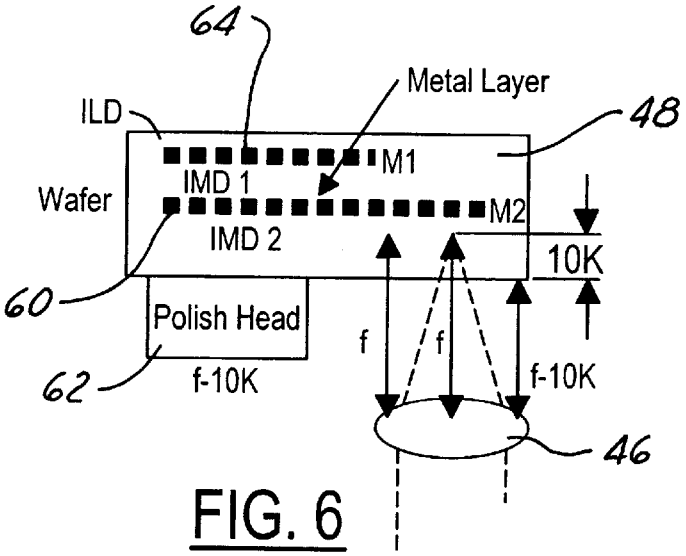
FIG. 6 is a diagrammatic view similar to FIG. 4, but depicting a wafer having two differing IMD layers.

FIG. 6 is a view similar to FIG. 4, but depicts a second metal layer 64 which may be an IMD layer of material. Past optical end point detection systems had difficulty in detecting the end point when two layers 60, 64 were present for the reason that the light being focus onto the wafer surface passed through the first layer 60 and was partially reflected by the second layer. Prior art detection systems were unable to resolve the light components reflected from the two layers 60, 64. In accordance with the present invention, however, the components of light reflected from the second layer 64 are negligible, the primary detected light reflection components originating from only the first layer 60. In other words, because of the relatively narrow depth of focus of the lens 46, this intensity of the detected light is quite high at a distance corresponding to the lens' focal length which is set to correspond with the depth of the first layer 60.

Figure 5:
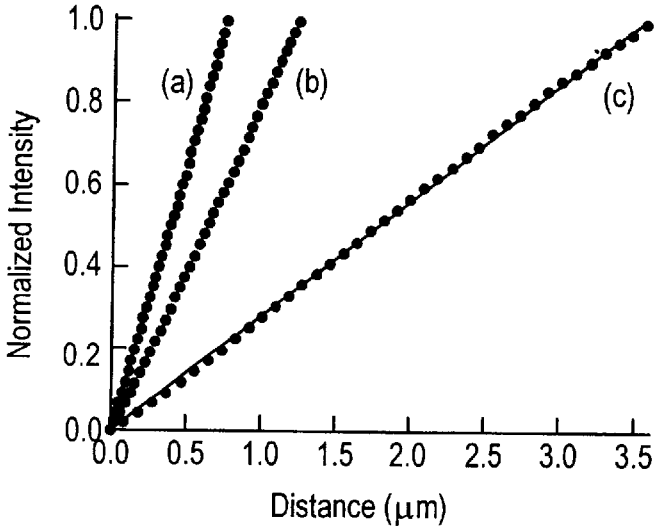
FIG. 5 is a chart showing the relationship between normalized intensity of reflected light and distance form the wafer surface for three optical systems having differing numerical apertures.

FIG. 5 is a plot of the normalized intensity that is detected as a function of distance for three optical systems in accordance with the present invention respectively possessing numerical apertures of 0.85, (curve a) 0.65, (curve b) and 0.40, (curve c). The depth of resolution and the dynamic range for each of these systems is as follows:

| | Numerical Aperture | Depth Resolution | Dynamic Range |
|---|---|---|---|
| Line (a) | 0.85 | 2 nm | 0.78 $\mu$m |
| Line (b) | 0.65 | 4 nm | 1.28 $\mu$m |
| Line (c) | 0.40 | 12 nm | 3.60 $\mu$m |

Figure 7:
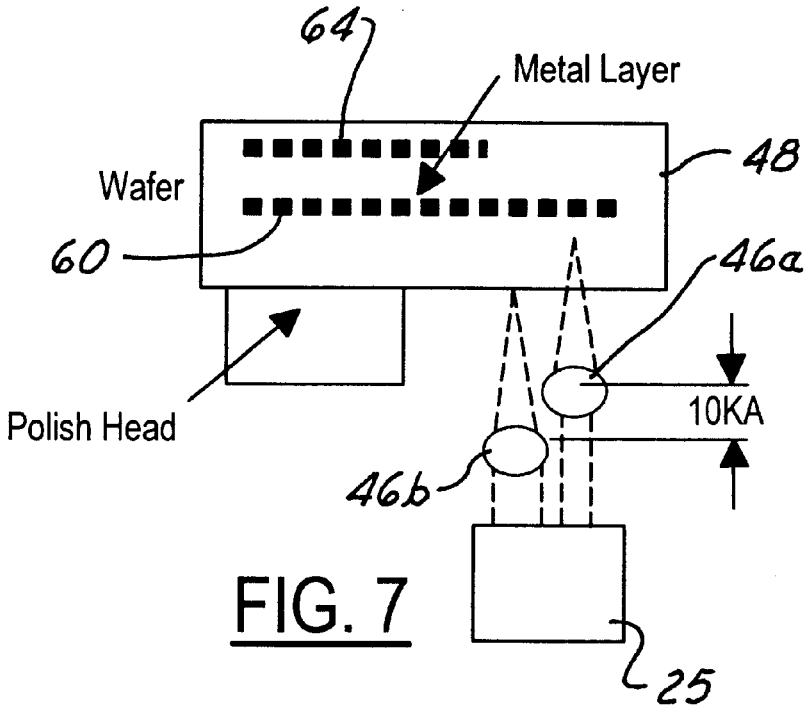
FIG. 7 is a view similar to FIG. 6, but depicting the use of a second optical detection system employed with a deformable polishing head.

Reference is now made to FIG. 7 which depicts an alternate form of the optical based end point detection system of the present invention. The system shown in FIG.

7 is similar to that depicted in FIGS. 2, 6, and 8 but further employs a second light source, second detector, and second objective lens. As in the previously described embodiment, the light source may comprise two separate laser diodes 25 and associated detectors 66 respectively cooperating with a pair of confocal objective lenses 46*a*, 46*b*. Lens 46*b* is positioned such that its focal point is at the surface of the wafer at the starting point of the CMP process, whereas lens 46*a* is positioned such that its focal point is positioned at the plane corresponding to the first IMD layer 60. This arrangement is necessary in those cases where the CMP process employs a deformable polishing head 62. Since the wafer 48 is pressed down onto the polishing head 62, the wafer surface is displaced as the polishing head 62 is deformed, thus changing the distance between the wafer surface and the objective lenses 46*a* and 46*b*.

Accordingly, the focal length of the lenses become variable rather than fixed. Lens 46*b* and its associated detector detects the starting point of the contact surface between the polishing head 62 and the wafer surface. Detecting the starting point of the wafer surface can be carried out by either of two techniques. First, a highly reflective, thin metal compound may be applied to the wafer surface before commencing CMP. This may be accomplished by first dipping the wafer surface in an acid and thereafter dipping it in a reflective metal compound to thereby form a highly reflective surface on the wafer 48. Alternatively, a fluorescent material may be introduced into the polishing solvent or slurry so that the wafer surface fluoresces at the starting point of the CMP process. In either case, the lenses 46*a* and 46*b* are longitudinally displaced by a distance corresponding to the depth of material to be removed. As shown in FIG. 7, this depth amounts to 10,000 angstroms, which is also the focal length of lens 46*a*. With the exact position of the wafer surface having been determined by the lens 46*b* and associated detector at the starting point of the CMP process, adjustments can then be made in the position of lens 46*a* to compensate for the distance that the polishing head 62 is deformed.

From the foregoing, it may be appreciated that a novel method of detecting the end point of a CMP process is provided which includes the steps of directing light from a source of light, preferably a laser diode, through a focusing lens; focusing the light passing through the lens onto a surface of the wafer such that the focal point is positioned in a plane corresponding to that of the end point; directing light reflected from the wafer surface back through the lens and, detecting the intensity of the reflected light, wherein the detected, reflected light intensity is related to the end point.

It is apparent that the present invention described above not only provides for the reliable accomplishment of the objects of the invention, but does so in a particularly economical and efficient manner. It is recognized, of course, that those skilled in the art may make various modifications or additions to the preferred embodiment chosen to illustrate the invention without departing from the spirit and scope of the present contribution to the art. Accordingly, it is to be understood that the protection sought and to be afforded hereby should be deemed to extend to the subject matter claimed and all equivalents thereof fairly within the scope of the invention.

What is claimed is:

1. A method of detecting an end point of a chemical mechanical polishing (CMP) process used in processing a semiconductor wafer, comprising the steps of:

(A) generating light from a light source of laser diode and passing through a focusing lens such that the light is focused onto the said wafer at a distance from the lens corresponding to the end point of the CMP process;

(B) passing light reflected from said wafer back through said focusing lens and onto said laser diode; and (C) detecting the intensity of light as a power state received by said laser diode, the detected light intensity being related to said end point.

2. The method of claim 1 including the step of generating a beam of laser light, and step (A) includes directing said beam towards said lens.

3. The method of claim 1, including the step of directing light from said light source through an aperture, such that light originating from said source originates from a point.

4. The method of claim 1, wherein measuring the power state of said laser diode is performed by measuring the electrical current flowing to said diode from an electrical current source.

5. The method of claim 1, including the step of stopping the CMP when the light intensity detected in step (C) has reached a pre-selected value.

6. A method of detecting an end point of a chemical mechanical polishing (CMP) process used in processing a semiconductor wafer having at least two layers of a metallic compound comprising the steps of:

(A) directing light beam from a light source through a focusing lens;

(B) focusing the light passing through said lens in step (A) onto the wafer during the CMP process at a distance corresponding to said end point;

(C) directing light reflected from said wafer surface back through said lens, wherein the intensity of said reflected light is related to the distance from said lens to said wafer surface, said distance being related to said end point; and, (D) detecting the intensity of the light directed back through said lens in step (C).

7. The method of claim 6, wherein:

step (A) includes directing a beam of laser light from a laser light source through said lens, step (C) includes focusing the reflected light onto the beam directed in step (A), and step (D) includes measuring the electrical current used by said laser light source to produce said light beam, said measured current being related to said detected light.

8. The method of claim 1, including the steps of applying a layer of reflective material or said wafer surface prior to the commencement of said CMP process, and detecting light reflected from said reflective material, said reflective material indicating a starting depth of said CMP process.

9. The method of claim 8, wherein said applying step includes depositing a layer of reflective metal compound on said wafer surface.

10. The method of claim 8 wherein said applying step includes depositing a fluorescent solvent on said wafer surface.

11. A method of detecting an end point of a chemical mechanical polishing (CMP) process, wherein the surface of a semiconductor wafer is pressed into contact with a deformable polishing head, comprising the steps of:

(A) focusing light from a first light source onto said wafer surface;

(B) at the commencement of said CMP process, detecting the intensity of light reflected from said wafer surface and originating from said first light source, the detected light from said first source representing the start point of said CMP process;

(C) directing light from a second light source onto said wafer surface;

(D) focusing the light directed in step (C) at a focal point corresponding to a depth into said wafer representing said end point.

12. The method of claim 11, including the step of adjusting said focal point based on the intensity detected in step (B).

13. Apparatus for detecting an end point of a chemical mechanical polishing (CMP) process used in processing a semiconductor wafer, comprising;

at least a first light source;

at least a first detector for detecting the intensity of light originating from said source and reflected from the surface of said wafer; and, at least a first optical lens for focusing light from said source onto said wafer surface, and for focusing light reflected from said wafer surface onto said wafer, wherein the intensity of the light detected by said detector is related to the distance of said lens from said wafer surface, said distance being related to said end point.

14. The apparatus of claim 13, wherein said light source is a laser diode.

15. The apparatus of claim 12, wherein said detector includes means for sensing the level of electrical demanded by said laser diode, said current level being related to said detected light intensity.

16. The apparatus of claim 13, wherein said lens is positioned between said wafer surface and the combination of said detector and a said light source so as to act as a confocal lens.

17. The apparatus of claim 13, including means disposed between said lens and said detector for controlling the light focused onto said detector.

18. The apparatus of claim 13, wherein said lens is spaced from said wafer surface a pre- selected distance such that the intensity of said reflected light is as a maximum value when said end point is reached.

19. The apparatus of claim 13, including;

a second light source;

a second detector for detecting the intensity of light originating from said second light source and reflected from said wafer surface at the commencement of said CMP process;

a second optical lens for focusing light from said second source onto said wafer surface, and for focusing light reflected from said wafer surface onto said detector;

wherein said second detector detects the distance from said lens to said wafer surface corresponding to a start point of said CMP process.

* * * * *